US010714276B2

(12) United States Patent
Moszynski et al.

(10) Patent No.: US 10,714,276 B2
(45) Date of Patent: Jul. 14, 2020

(54) DISCONNECTING DEVICE WITH ARC EXTINGUISHING

(71) Applicant: Auto-Kabel Management GmbH, Hausen im Wiesental (DE)

(72) Inventors: Markus Moszynski, Erkelenz (DE); Wacim Tazarine, Erkelenz (DE)

(73) Assignee: Auto-Kabel Management GmbH, Hausen im Wiesental (DE)

( * ) Notice: Subject to any disclaimer, the term of this patent is extended or adjusted under 35 U.S.C. 154(b) by 0 days.

(21) Appl. No.: 16/463,121

(22) PCT Filed: Sep. 4, 2017

(86) PCT No.: PCT/EP2017/072082

§ 371 (c)(1),
(2) Date: May 22, 2019

(87) PCT Pub. No.: WO2018/095602

PCT Pub. Date: May 31, 2018

(65) Prior Publication Data

US 2020/0066465 A1 Feb. 27, 2020

(30) Foreign Application Priority Data

Nov. 22, 2016 (DE) ..... 10 2016 122 424

(51) Int. Cl.
*H01H 9/32* (2006.01)
*H01H 33/75* (2006.01)
(Continued)

(52) U.S. Cl.
CPC ..... *H01H 9/32* (2013.01); *H01H 33/75* (2013.01); *H01H 33/88* (2013.01); *H01H 39/006* (2013.01); *H01H 2039/008* (2013.01)

(58) Field of Classification Search
CPC ..... H01H 9/32; H01H 39/002; H01H 39/004; H01H 39/006; H01H 2039/008; H01H 85/10; H01H 85/18
(Continued)

(56) References Cited

U.S. PATENT DOCUMENTS 3,895,552 A * 7/1975 Lagofun ..... B23D 15/145 83/580
7,123,124 B2 * 10/2006 Caruso ..... H01H 39/006 337/157
(Continued)

FOREIGN PATENT DOCUMENTS

DE 102004010746 A1 12/2004
DE 102010035684 A1 3/2012
(Continued)

*Primary Examiner* — William A Bolton
(74) *Attorney, Agent, or Firm* — The Webb Law Firm

(57) ABSTRACT

Disconnecting device for an energy conductor comprising at least one first connection part, at least one second connection part, at least one disconnection point arranged between the first and second connection parts, the disconnection point forming a current path between the first and second connection parts in a closed state and disconnecting a current path between the first and second connection parts in an open state, the disconnecting device having a flowable medium which is arranged in a guide housing and separates the disconnection point driven by a drive, the flowable medium at least partially surrounding the disconnection point at the moment of disconnection, and the disconnecting device having a bolt which is moved into the disconnection point immediately after the disconnection of the disconnection point by the flowable medium.

20 Claims, 3 Drawing Sheets

(51) Int. Cl.
*H01H 33/88* (2006.01)
*H01H 39/00* (2006.01)

(58) Field of Classification Search
USPC ..... 200/61.08, 61.04; 218/92, 16, 43; 83/639.4
See application file for complete search history.

(56) References Cited

U.S. PATENT DOCUMENTS

| | | | | |
|---|---|---|---|---|
| 7,222,561 | B2 * | 5/2007 | Brede | B23D 15/145 200/61.08 |
| 7,511,600 | B2 * | 3/2009 | Von Behr | H01H 39/006 200/61.08 |
| 8,432,246 | B2 * | 4/2013 | Suzuki | H01H 9/12 200/61.08 |
| 8,957,335 | B2 * | 2/2015 | Sprenger | B23D 15/145 200/61.04 |
| 2002/0067033 | A1 * | 6/2002 | Sato | B60R 21/231 280/743.1 |
| 2013/0175144 | A1 | 7/2013 | Sprenger et al. | |
| 2014/0061161 | A1 | 3/2014 | Nakamura et al. | |
| 2014/0326122 | A1 * | 11/2014 | Ukon | H01H 39/006 83/468.1 |
| 2016/0293362 | A1 * | 10/2016 | Fukuyama | H01H 39/006 |
| 2016/0336131 | A1 | 11/2016 | Fellmer et al. | |

FOREIGN PATENT DOCUMENTS

| | | | |
|---|---|---|---|
| DE | 102012013491 | B3 | 9/2013 |
| DE | 102015107579 | B3 | 8/2016 |
| DE | 102015112141 | A1 | 1/2017 |

* cited by examiner

DISCONNECTING DEVICE WITH ARC EXTINGUISHING

CROSS-REFERENCE TO RELATED APPLICATIONS

This application is the United States national phase of International Application No. PCT/EP2017/072082 filed Sep. 4, 2017, and claims priority to German Patent Application No. 10 2016 122 424.3 filed Nov. 22, 2016, the disclosures of which are hereby incorporated by reference in their entirety.

BACKGROUND OF THE INVENTION

The subject matter relates to a disconnecting device for an energy conductor, in particular a motor vehicle energy conductor, comprising at least one disconnection point arranged spatially between a first and a second connection part in a closed state of the disconnecting device and a bolt which moves into the disconnection point immediately after the disconnection of the connection parts. In addition, the subject matter concerns a method for the disconnection of an energy line.

The electrical protection of energy conductors, in particular motor vehicle energy conductors, represents a safety-relevant area of motor vehicle technology with regard to ensuring the safety of vehicle occupants. In particular, motor vehicle energy conductors which carry a high current, such as the starter and generator cables, the main battery cable and/or other current-carrying cables of the vehicle electrical system, must be quickly disconnected from the vehicle battery in the event of an accident. If this is not ensured, short-circuits with very high currents may occur in the event of accidents. The high short-circuit currents lead to the ignition of arcs. These must be extinguished reliably in order not to endanger the safety of the vehicle occupants.

Nowadays, disconnecting devices are frequently used, in which the energy conductors are cut through by pyrotechnic disconnecting devices in the event of an imminent short circuit. The disconnection of energy conductors by means of pyrotechnic disconnection devices is usually achieved either by mechanically cutting the energy conductor or by accelerating a bolt out of a cylinder, whereby in the closed state a current path is formed between the bolt and the cylinder, which is cut through by the disconnection device, e.g. the bolt.

A disadvantage of the conventionally used pyrotechnic disconnection devices is the fact that arcs can form across the gap at the disconnection point at the moment of disconnection of a current-carrying cable, whereby the connection parts remain electrically connected to each other at least temporarily. This is particularly often the case with high-voltage applications in electric or hybrid vehicles, where the generation of electric arcs is particularly promoted due to the high currents and potential differences.

State-of-the-art applications are known for suppressing or extinguishing electric arcs in which the disconnection point is broken open by pressing a flowable medium, driven by a drive, in the direction of the disconnection point. The fact that the flowable medium flows at least partially around the disconnection point at the moment of disconnection is intended to ensure that the flowable medium propagates in the air gap formed between the two connection parts, whereby the formation of an arc can be suppressed or an arc can be extinguished.

However, the disadvantage of the method described is that the extinguishing or suppression of electric arcs is only reliable at limited voltages or currents, which limits the range of application of the known method, in particular to 48 V on-board electrical systems.

For this reason, the subject-matter was based on the object of providing a disconnecting device that enables the safest possible disconnection of a current-carrying conductor, even in high-voltage applications, in particular above 100 V, preferably above 400 V. The device is designed for use in high-voltage applications, in particular above 100 V, preferably above 400 V.

SUMMARY OF THE INVENTION

This object is solved by a disconnection device according to the present disclosure.

The disconnecting device may be designed in such a way that the first and second connection parts are current-carrying components of a motor vehicle energy conductor. The first and second connection parts can also be current carrying components of energy conductors of other vehicles, of building installations, of electrically operated machines or signal boxes.

It has been recognized that the extinguishing or suppression of electric arcs by means of a flowable medium is not sufficiently safe and reliable, as a result of which the safety of vehicle occupants is endangered in the motor vehicle area, it is proposed that the disconnection device according to the subject-matter has, in addition to the flowable medium, a bolt which suppresses the generation of electric arcs by entering the disconnection point and/or extinguishes arcs which have ignited by entering the disconnection point.

In order to ensure sufficiently fast and safe extinguishing of an arc after disconnection of a current carrying conductor, it is proposed that the bolt may be made of a dielectric resistant insulation material with low electrical conductivity, preferably plastic, ceramic or resin. The insulating element may preferably be formed from an insulating material having a dielectric strength of at least more than 5 kV/mm, preferably more than 20 kV/mm, particularly preferably more than 50 kV/mm, and/or having a specific electrical conductivity of at least less than 10 5 S*cm-1, preferably less than 10–10 S*cm-1, particularly preferably less than 10 15 S*cm-1.

According to an advantageous embodiment, it is proposed that the disconnecting device has a counter bearing in addition to the first bolt, whereby the two bolts in a closed state of the disconnecting device are preferably arranged on opposite sides of the disconnection point separated by the disconnection point.

In this way, for example, it is possible for the bolt and the counter bearing to move relative to each other after the connection parts have been separated, in particular for the bolt to move towards the counter bearing, whereas the counter bearing is stationary. It is advantageous that at least the bolt moves into the disconnection point after disconnection of the connection parts in such a way that the bolt is arranged as precisely as possible on the counter bearing and thus an arc forming in the area of the disconnection point can be "cut off" safely and reliably.

If only the bolt moves after the connection parts have been disconnected, this has the advantage that the disconnecting device only has to have one drive, since the counter bearing can be fixed, for example, in the housing of the disconnecting device, while the bolt can be mounted movably in the housing and is accelerated by the drive in the direction of the disconnection point.

In order to be able to "cut off" a forming arc as efficiently as possible in the region of the disconnection point, it is proposed that the bolt and the counter bearing have complementary, in particular accurately fitting, shapes in their contact region, the bolt preferably having a V-shaped end section, while the counter bearing has a complementary V-shaped end section. It goes without saying that bolts and counter bearings can have other shapes in their contact area as well, such as sickle or semicircular shapes, or even three-four or five-pointed shapes. The contact areas of bolt and counter bearing should be as complementary to each other as possible, in particular they should fit perfectly to each other.

In order to be able to "cut off" an arc as efficiently as possible in the area of the disconnection point, it is also proposed that bolts and counter bearings are preferably arranged on a common axis with the disconnection point, in particular essentially perpendicular to the current path between the first and second connection part.

Preferably, value is placed on the most exact possible alignment of the axis of the bolt and counter bearing, since reliable and safe extinguishing and prevention of arcing can only be achieved by maintaining an exact alignment to each other.

In an embodiment in which not only the bolt but also the bolt and counter bearing move towards each other when the connection parts are separated, the bolt and counter bearing are preferably arranged substantially equidistantly to the disconnection point in the closed state of the disconnecting device. This enables the bolts and counter bearings to be arranged as quickly and accurately as possible at the disconnection point, enabling an arc between the connection parts to be extinguished shortly after disconnection.

In particular, where high currents flow, it makes sense to protect the circuits. It is advantageous that the disconnecting device has a current carrying capacity of more than 50 amperes in the closed state, preferably more than 100 amperes, in particular more than 400 amperes.

Likewise, wherever comparatively high voltages are present, it makes sense to protect the circuits by means of a fuse. In order to ensure safe disconnection, for example, of cables in high-voltage vehicle electrical systems, the disconnecting device is advantageously designed in such a way that a potential difference of more than 48 V, preferably more than 100 V, in particular up to 500 V is present between the connection parts in the open state.

In order to achieve a low-loss power supply in a closed state of the disconnecting device, the connection parts and the disconnection point can preferably be made of an electrically conductive material such as copper or aluminium. The connection parts and the disconnecting point can also be made of different materials. Advantageously, the material of the connection parts as well as the disconnection point can be adapted to the respective requirements.

The connection parts can be shaped for connection to electrical lines and cables and have cable lugs to accommodate the cables. The connection parts can also be integrated into a vehicle electrical system. When the disconnecting device is closed, an electrical current flows between a consumer and a power source via the connection parts and a disconnection point.

In order to achieve a safe disconnection, the disconnection point must have a lower breaking strength than the housing or the connection parts. For this reason, it is proposed that the disconnection point has a predetermined breaking point, in particular at least a taper or recess at the joint or a solder joint between the connection parts. The disconnection line between the connection parts should run along the disconnection point and the gap between the connection parts should form, which separates the current path. This gap runs along the disconnection point. The predetermined breaking point can, for example, be a tapering along a line across the surface of a connection part. Connection parts can also be soldered together to form the disconnection point. It is also possible that the disconnection point is tapered at at least two points, each connected to a connection part, and the tapers are broken open by the pressure of the flowable medium and the disconnection point is detached from the connection parts.

In order to allow a precise bending line at the disconnecting point, it is proposed that the disconnecting point be notched with respect to a respective connection part in such a way that the respective recess, groove or the like runs along a predetermined bending line of the disconnecting point. The target bending line defines where the connection parts are to be bent. This makes it possible to define exactly which space the disconnection point occupies when opening, so that this space can be made available in the guide housing.

According to an advantageous embodiment, it is proposed that the drive with which the fluid is driven is a compressed air controlled drive, preferably a pyrotechnically controlled drive or a mechanical drive.

A pyrotechnic drive is characterised by a pyrotechnic propellant charge which, when triggered, generates a pressure pulse to drive the flowable medium arranged in a guide housing. The pyrotechnic drive can be triggered via an ignition cable.

A mechanical drive, for example, can be a foam that expands rapidly when it comes into contact with another material, such as water, and thus exerts a pressure pulse on the flowable medium to separate the disconnection point. A strong tensioned spring can also be used as a mechanical drive. Other mechanical drives are also possible.

Just like activation by overpressure in the guide housing, activation can also take place via an under pressure generated in the guide housing. In this case implosive drives can be used, for example. Depending on whether an over or under pressure is exerted, the flowable medium can be arranged at least either on the side facing the actuator or on the side of the disconnection point facing away from the actuator.

Since arcing can occur when the connection parts are separated, it is proposed that the drive moves the flowable medium in the direction of the disconnection point in such a way that the flowable medium is in contact with the disconnection point at the moment of disconnection. This means that an arc formed between the connection parts can already be extinguished by the flowable medium.

In order to direct the energy emitted by the drive during activation particularly efficiently onto the flowable medium, it is proposed that the bolt in the guide housing be arranged so that it can be displaced along the axial direction of propagation of the guide housing. The bolt can be accelerated by the pressure pulse of the drive in the direction of the flowable medium and exert a pressure on it that is sufficient to separate the disconnection point. In addition, the bolt can be used to prevent a gas bubble, which for example forms before the drive in the event of activation, from moving through the flowable medium towards the end point without the flowable medium being sufficiently accelerated in the direction of the disconnection point.

If the opening is located on the side of the disconnection point facing away from the actuator, an overpressure, which occurs when the disconnection point is separated, can escape particularly easily from the room and the gas present in the side of the disconnection point facing away from the actuator cannot exert any counterpressure on the disconnection point, which could prevent safe disconnection.

The flowable medium preferably has the property that it is incompressible. The drive pushes the flowable medium in the direction of the disconnection point so that it breaks open the disconnection point and surrounds the disconnection point. Since the flowable medium is preferably incompressible, it is possible to keep the drive as small as possible. The entire energy of the drive is applied directly to the disconnection point.

In order to ensure optimum dispersion of the flowable medium in the guide housing, it is proposed that the flowable medium be a liquid or a free-flowing bulk material, in particular sand, and/or be liquid, pasty, foamy, gel or granular. Preferably the flowable medium is viscous enough to arrange itself in the area of the open disconnection point, but on the other hand fluid enough to be moved sufficiently quickly in the direction of the disconnection point.

In order to extinguish the formation of electric arcs already via the flowable medium, it is proposed that the flowable medium is formed from an insulating material, the insulating material having a specific electrical conductivity of at least less than 10−5 S*cm-1, preferably less than 10−10 S*cm-1, particularly preferably less than 10−15 S*cm-1.

A further subject-matter is a method for disconnecting an energy conductor comprising the steps of receiving at least one disconnection signal, triggering at least one signal, in particular triggering a control signal for igniting an ignition squib, disconnecting a connection between a first and a second connection part arranged at a disconnection point by a flowable medium driven by a drive, moving a bolt into the disconnection point, immediately after disconnection of the disconnection point by the flowable medium.

The method for disconnecting an energy conductor may preferably be carried out in such a way that by moving the bolt into the disconnection point, arcing can be suppressed and/or arcs can be extinguished by moving the bolt into the disconnection point.

In order to protect the vehicle occupants of a motor vehicle reliably and at the same time simply against a short circuit of a current-carrying line in the event of an accident, the method for disconnecting an energy line, in particular the disconnecting signal, can preferably be coupled to the triggering of an airbag control signal.

Alternatively or cumulatively to the coupling of this method to an airbag control signal, the method may also be coupled to the behaviour of other vehicle components such as the belt tensioner, the belt force limiter or the roll bar. In particular, the process in question can also be coupled to signals from crash or impact sensors.

According to an embodiment, it is proposed that the disconnection signal is received by a sensor, preferably a reed sensor, a Hall sensor or an induction sensor.

In order to transmit the isolating signal safely and without interference, the isolating signal can preferably be transmitted electrically isolated from the circuit. This can be achieved in particular by placing the sensor electrically isolated, for example, on a housing of the disconnecting device.

BRIEF DESCRIPTION OF THE DRAWINGS

In the following, the subject is explained in more detail using a drawing showing embodiments. The drawings show.

DESCRIPTION OF THE INVENTION

Figure 1:
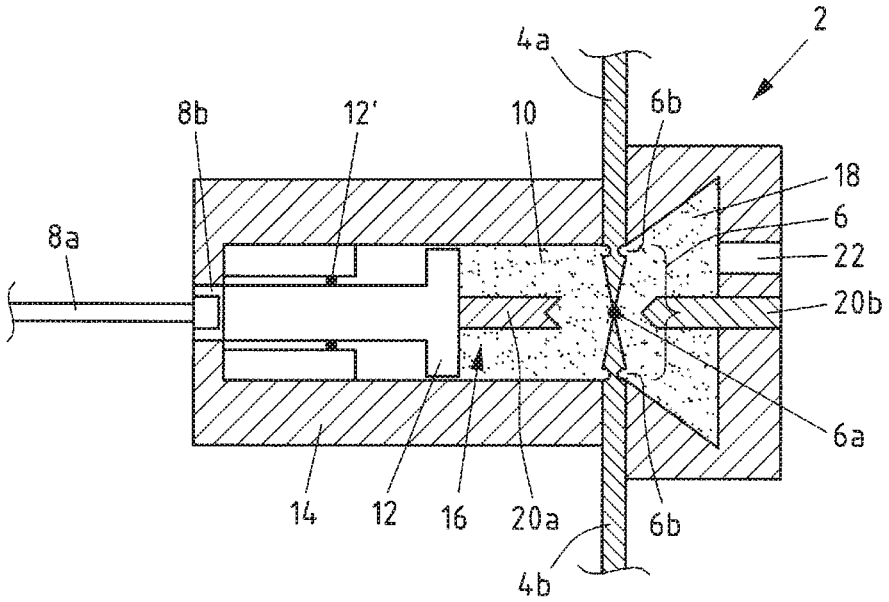
FIG. 1 a first disconnecting device according to a first embodiment in the non-activated state.

FIG. 1 shows a disconnecting device 2 with a housing 14. Two connection parts 4*a* and 4*b* protrude into the housing 14, which are connected to each other at a disconnecting point 6*a*—which is formed here as a solder joint. The connection parts 4*a, b* may preferably be made of an electrically conductive material such as copper or aluminium. The connection parts 4*a, b* can also be made of different materials.

A pyrotechnic drive 8*b* that can be controlled via an ignition wire 8*a* is arranged at the housing 14. In addition, a piston 12 is arranged between the pyrotechnic drive 8*b* and the disconnection area 6, which is movable along the axial direction of the guide housing 14 in a channel of the guide housing 14 and has a seal 12', with the aid of which penetration of gaseous or liquid particles into the channel is prevented. The intermediate space 16 between the piston 12 and the disconnection area 6 is completely filled with a flowable medium 10.

The flowable medium 10 can be a liquid, a gel or a free-flowing bulk material. For example, the flowable medium 10 can be silicone or sand.

In addition, a bolt 20*a* projecting into the flowable medium and having a V-shaped recess at its front end is attached to the piston 12. The bolt 20*a* is preferably made of an electrical insulation material, in particular plastic or ceramic.

A room 18 is also provided on the side of the disconnection point 6*a* facing away from the actuator 8*b*, in which an opening 22 can also be arranged. It can be seen that notches 6*b* can be provided in the disconnection area 6 in the area of the inner circumference of the guide housing 14, defining the predetermined bending lines along which the connection parts 4*a, b* are to be bent.

In addition, it can be seen that space 18 has a radially increasing volume into which the connection parts 4*a, b* can be bent.

Furthermore, the disconnecting device has a further bolt 20*b* projecting into the space 18 as counter bearing, which is arranged substantially on an axis running together with the first bolt 20*a* and the disconnecting point 6*a*, which axis runs substantially perpendicular to the connecting axis of the first and second connection part 4*a, b* according to FIG. 1. The bolt 20*b* also has a V-shaped projection on its end face, which is preferably complementary to the V-shaped recess on the bolt 20*a* on the end face.

The end faces of bolts 20*a*, 20*b* are preferably complementary to each other. The end faces of bolts 20*a*, 20*b* preferably have corresponding cross-section profiles. Preferably, the first and second bolts have complementary shapes on the end faces, in particular a perfect fit.

Figure 2:
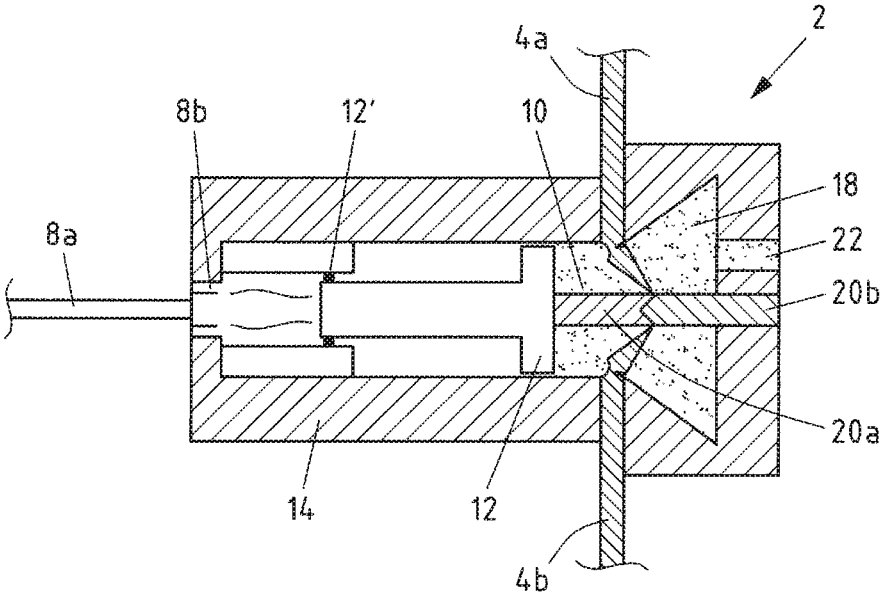
FIG. 2 the disconnecting device according to FIG. 1 in the activated state.

FIG. 2 shows the disconnecting device 2 according to FIG. 1 in the triggered state. In the triggered state, an ignition pulse was transmitted to the drive 8*b* via the ignition wire 8*a*, which then explodes. The explosion energy acts as a pressure pulse on the piston 12 arranged in the housing. The piston 12 together with the bolt 20*a* is then accelerated in the direction of the disconnection point 6*a*.

The piston 12 accelerates part of the flowable medium arranged between the piston and the disconnection point 6*a* in the direction of the disconnection point 6*a*. As can be seen, the pressure and the impulse of the flowable medium 10 are sufficient to break open the disconnection point 6*a* so that a gap is created between the connection parts 4*a*, 4*b*. The flowable medium 10 penetrates into this gap.

At the moment the connection parts 4*a*, 4*b* are disconnected via the disconnection point 6*a*, an arc is ignited across the gap. This arc can already be extinguished via the flowable medium 10 surrounding the disconnection point 6*a* immediately after disconnection. However, since it has been recognized that reliable extinguishing of an arc by means of a flowable medium is not sufficiently safe and reliable, the arrangement of the bolt 20*a*, which safely and reliably separates an arc by moving it into the disconnection point 6*a* immediately after the disconnection of the connection parts, is additionally provided in the disconnecting device 2 according to the subject matter, whereby the movement into the disconnection point 6*a* is carried out in accordance with FIG. 2 in such a way that the first bolt 20*a* is arranged as accurately as possible on the second bolt 20*b*. In addition, moving the bolt 20*a* into the disconnection point 6*a* causes a final extinction of an arc.

The excess pressure created in the housing 18 by bending the connection parts 4*a, b* and the inlet of the flowable medium 10 previously arranged in the intermediate space 16 can escape through the opening 22. The opening 22 can be so small that the flowable medium arranged in room 18 cannot escape from the opening when the disconnecting device 2 is inactive. Alternatively, the opening can also be closed with a bursting disc not shown here, which only bursts at a certain pressure and then allows the flowable medium 10 to escape.

With the help of bolt 22*a* and bolt 22*b* it is possible to extinguish an arc. To extinguish an arc, the second bolt 20*b* does not necessarily have to be present. It is also conceivable that the prevention of the ignition or extinction of an arc can only take place via the bolt 20*a*, whereby the bolt 20*a* is then preferably moved further through the disconnection point, so that a resulting arc "breaks off".

Figure 3:
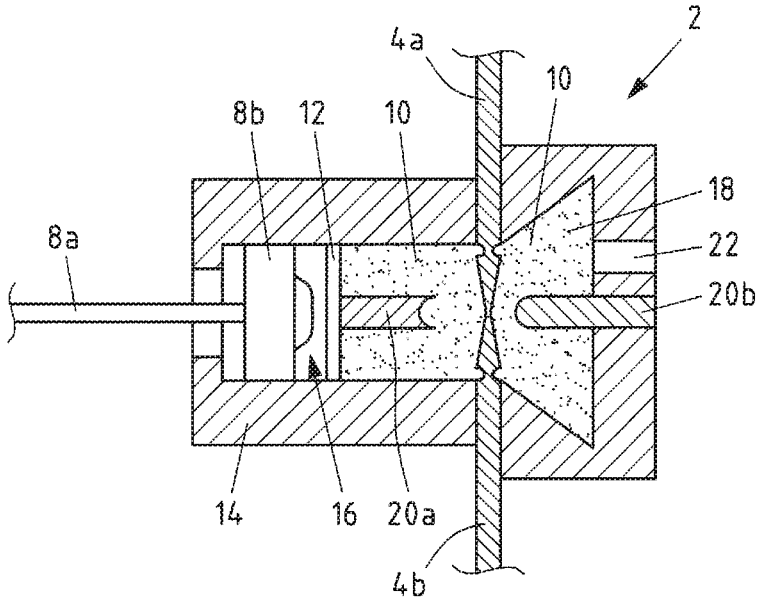
FIG. 3 a second disconnecting device according to a second embodiment in the non-activated state.

FIG. 3 shows another embodiment of a disconnecting device 2 in which the flowable medium 10 is also arranged on the side of the disconnection point 6*a* facing away from the actuator 8*b* in room 18. It can also be seen that, in contrast to the embodiment shown in FIG. 1, the disconnection point 6*a* is not soldered but only tapered.

Furthermore, the bolt 20*a* attached to the piston 12 is sickle-shaped or semi-circular in the cross-sectional profile on the end face, whereas the second bolt 20*b* arranged in space 18 has a complementary cross-sectional profile on the end face.

Figure 4:
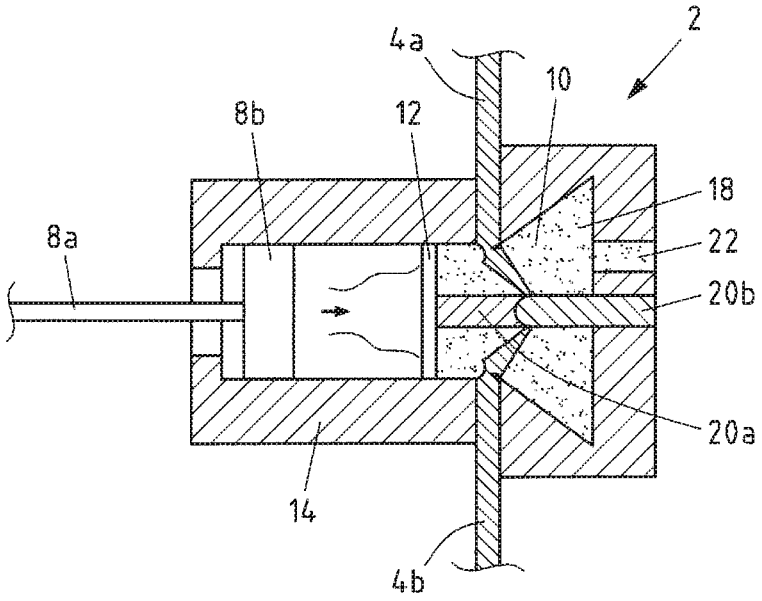
FIG. 4 the disconnecting device according to FIG. 3 in the activated state.

When the disconnection device 2 is triggered according to FIG. 3, the disconnection point 6*a* is also separated as shown in FIG. 4.

FIG. 4 shows the disconnecting device 2 according to FIG. 3 in the triggered state. It can be seen that the actuator 8*b* was ignited and the flowable medium 10 was accelerated to the disconnection point 6*a* in such a way that it separates the disconnection point 6*a* and there a gap is created between the first and the second connection part 4*a, b* into which the flowable medium 10 penetrates.

At the moment the connection parts 4*a, b* are disconnected, an arc may also ignite here, which can either already be extinguished via the flowable medium 10 surrounding the point of disconnection 6*a* immediately after disconnection or finally safely and reliably by the immediate subsequent insertion of the first bolt 20*a* into the point of disconnection 6*a*. Also according to the design example shown in FIG. 4, the bolt 20*a* is moved into the disconnection point in such a way that the bolt 20*a* lies against the bolt 20*b* at the end face. Thus, an arc can be safely and reliably "cut off".

Figure 5:
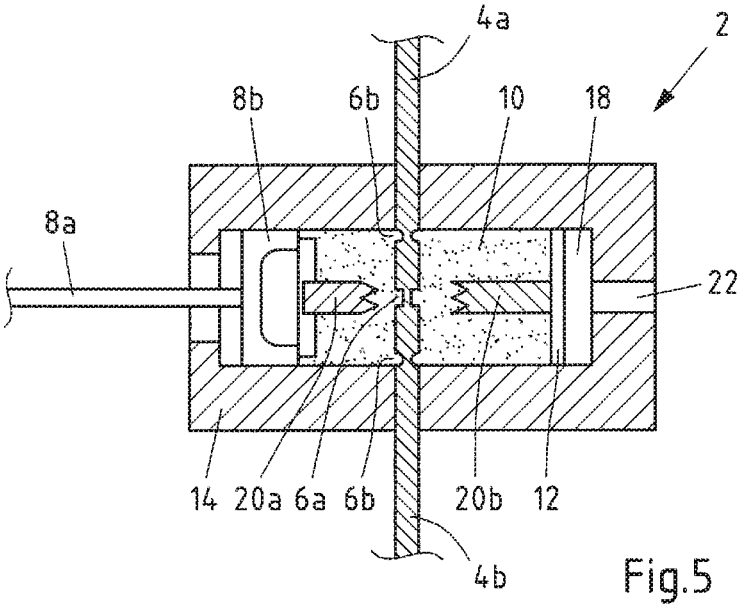
FIG. 5 a third disconnecting device according to a third embodiment in a non-activated state.

FIG. 5 shows another embodiment of a disconnecting device 2 in which the flowable medium 10 is arranged exclusively on the side of the disconnection point 6*a* remote from the actuator 8*b*. According to this example, not the first 20*a*, but the second bolt 20*b* is arranged on the piston 12. In addition, the second bolt 20*b* has a serrated cross-sectional profile on the face side, while the first bolt 20*a*, which is fixed to the housing, has a complementary cross-sectional profile on the face side. In the example shown in FIG. 5, the disconnection point 6 also has a predetermined breaking point 6*a* which is designed as a taper. The actuator 8*b* is such that it implodes when activated and causes a vacuum in room 16.

Figure 6:
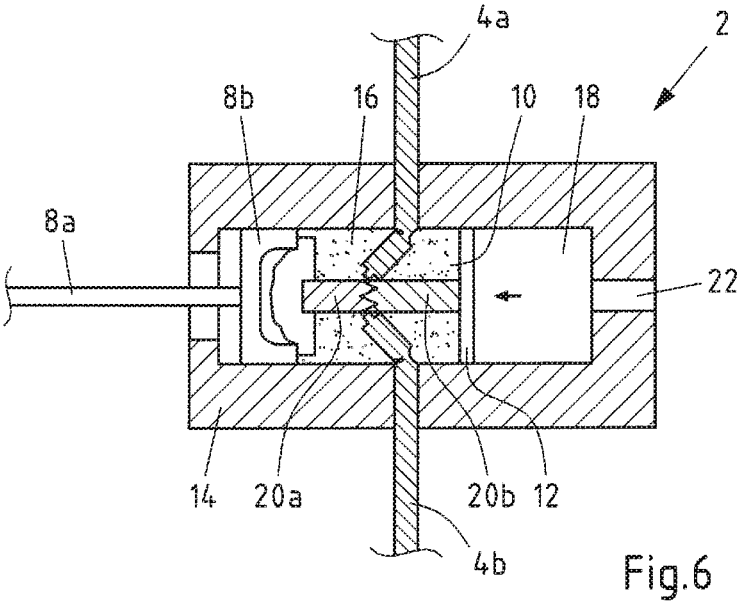
FIG. 6 the disconnecting device according to FIG. 5 in the activated state.

An activated disconnecting device according to FIG. 5 is shown in FIG. 6. It can be seen that the negative pressure created in room 16 breaks up disconnection point 6 and creates a gap between connection parts 4*a* and 4*b*. The flowable medium 10 penetrates into this gap at the moment of disconnection and the bolt 20*b* immediately afterwards. Gas can enter the interior of room 18 via opening 22, so that the negative pressure in room 16 causes the disconnection point 6 to break open and form a gap. Here, too, it can be seen that both the flowable medium 10 and the bolt 20*b* are arranged in the area of the gap, so that a resulting arc can be extinguished safely and reliably by the bolt 20*b*, if not already via the flowable medium 10. According to the embodiment shown in FIG. 6, the bolt 20*b* is also moved into the disconnection point in such a way that the bolt 20*b* is arranged as accurately as possible on the bolt 20*a*.

Figure 7:
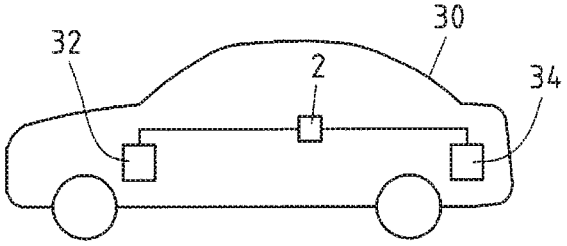
FIG. 7 an electric vehicle with a disconnecting device according to the subject matter.

FIG. 7 shows an electric vehicle 30 with a drive battery 32 and an electric drive train 34. The disconnecting device 2 is arranged between the drive battery 32 and the electric drive train 34. In the event of an accident of the vehicle 30, the electrical disconnecting device 2 can be activated and the current path between the battery 32 and the drive train 34 can be disconnected. The disconnecting device 2 can be arranged particularly close to the battery 32, for example directly at the battery poles. This ensures that the danger to occupants and rescue personnel is minimised.

The invention claimed is:

1. A disconnecting device for an energy conductor comprising:

at least a first connection part;

at least a second connection part;

at least one disconnection point arranged between the first and the second connection part;

the at least one disconnection point in a closed state forms a current path between the first and second connection parts and in an open state disconnects the current path between the first and second connection parts; and the disconnecting device has a flowable medium, wherein the flowable medium is an electrical insulation material having a specific electrical conductivity of less than $10^{-5}$ S*cm$^{-1}$, which is arranged in a guide housing and disconnects the at least one disconnection point driven by a drive, the flowable medium at least partially surrounds the at least one disconnection point at a moment of disconnection, wherein the disconnecting device has a bolt which moves into the at least one disconnection point immediately after disconnection of the at least one disconnection point by the flowable medium.

2. The disconnecting device according to claim 1, wherein the bolt within the disconnecting device suppresses formation of arcs by moving into the at least one disconnection point and/or extinguishes arcs which have ignited by moving into the at least one disconnection point.

3. The disconnecting device according to claim 1, wherein the bolt is formed from an electrical insulation material having a specific electrical conductivity of at least less than $10^{-5}$ S*cm$^{-1}$, wherein the insulation material is formed with a dielectric strength of at least more than 5 kV/mm.

4. The disconnecting device according to claim 3, wherein the bolt is formed from the electrical insulation material having the specific electrical conductivity of at least less than $10^{-10}$ S*cm$^{-1}$.

5. The disconnecting device according to claim 3, wherein the bolt is formed from the electrical insulation material having the specific electrical conductivity of at least less than $10^{-15}$ S*cm$^{-1}$.

6. The disconnecting device according to claim 3, wherein the insulation material is formed with the dielectric strength of at least more than 20 kV/mm.

7. The disconnecting device according to claim 3, wherein the insulation material is formed with the dielectric strength of at least more than 50 kV/mm.

8. The disconnecting device according to claim 1, wherein the disconnecting device has a counter bearing in addition to the bolt, the bolt and the counter bearing being arranged in the closed state of the disconnecting device on opposite sides of the at least one disconnection point which are separated by the at least one disconnection point.

9. The disconnecting device according to claim 8, wherein the bolt and the counter bearing are arranged on a common axis with the disconnection point.

10. The disconnecting device according to claim 8, wherein the bolt and the counter bearing are arranged equidistantly to the disconnection point in the closed state of the disconnecting device.

11. The disconnecting device according to claim 8, wherein the bolt and the counter bearing move relative to one another when the disconnecting device is opened, the bolt moving towards the counter bearing.

12. The disconnecting device according to claim 8, wherein contact regions of the bolt and the counter bearing have complementary, fitting, cross-sectional profiles, the bolt having a V-shaped cross-sectional profile, while the counter bearing has a complementary, V-shaped cross-sectional profile.

13. The disconnecting device according to claim 8, wherein the bolt and the counter bearing are substantially perpendicular to the current path between the first and second connection parts.

14. The disconnecting device according to claim 1, wherein the flowable medium is moved by the drive in a direction of the at least one disconnection point and exerts a pressure effecting the disconnection and/or the flowable medium is in contact with the at least one disconnection point at the moment of disconnection.

15. The disconnecting device according to claim 1, wherein the bolt is arranged so as to be displaceable along an axial direction of propagation of the guide housing, the bolt being driven by the drive, accelerating the flowable medium in a direction of the at least one disconnection point and/or increasing a pressure within the flowable medium.

16. The disconnecting device according to claim 1, wherein the flowable medium is at least one of a liquid or a free-flowing bulk material.

17. The disconnecting device according to claim 1, wherein the flowable medium is formed from an insulating material, the insulating material having a specific electrical conductivity of less than $10^{-10}$ S*cm$^{-1}$.

18. A method for disconnecting an energy conductor comprising the steps of:

receiving at least one disconnection signal;

triggering of at least one signal;

disconnecting a connection between a first and a second connection part arranged at a disconnection point by a flowable medium driven by a drive, wherein the flowable medium is an electrical insulation material having a specific electrical conductivity of less than $10^{-5}$ S*cm$^{-1}$; and moving a bolt into the disconnection point, immediately after disconnection of the disconnection point by the flowable medium.

19. The method for disconnecting the energy conductor according to claim 18, wherein an ignition of electric arcs is suppressed by moving the bolt into the disconnection point and/or ignited electric arcs are extinguished by moving the bolt into the disconnection point.

20. The method for disconnecting the energy conductor according to claim 18, wherein the triggering of the disconnecting device further comprises the triggering of an airbag.

* * * * *